United States Patent [19]

Erickson et al.

[11] 4,237,884

[45] Dec. 9, 1980

[54] MEDICATION DISPENSER

[76] Inventors: Victor Erickson, c/o George Spector, 3615 Woolworth Bldg., 233 Broadway; George Spector, 3615 Woolworth Bldg., 233 Broadway, both of New York, N.Y. 10007

[21] Appl. No.: 887,873

[22] Filed: Mar. 17, 1978

[51] Int. Cl.[3] ..... A61J 7/00

[52] U.S. Cl. ..... 128/222

[58] Field of Search ..... 128/222; 131/171 A, 131/8 A, 277, 1; 222/306, 376; 214/514; 424/2, 10; 221/252, 298, 251

[56] References Cited

U.S. PATENT DOCUMENTS

| | | | |
|---|---|---|---|
| 1,990,262 | 2/1935 | Bailey | 222/514 |
| 3,789,840 | 2/1974 | Rosenblatt | 128/260 |
| 3,980,766 | 9/1976 | Shaw et al. | 424/10 |
| 4,064,316 | 12/1977 | Curtis | 428/522 |

FOREIGN PATENT DOCUMENTS 1298432 6/1962 France .

*Primary Examiner*—John D. Yasko

[57] ABSTRACT

A medication dispenser-container for depositing medication tablets one at a time on a person's tongue to affect taste buds.

1 Claim, 3 Drawing Figures

Fig. 1
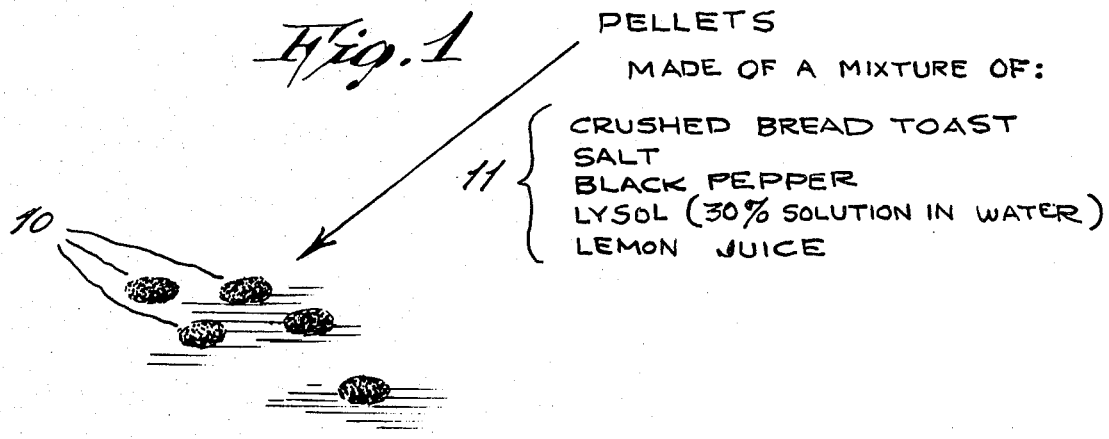
Fig. 2
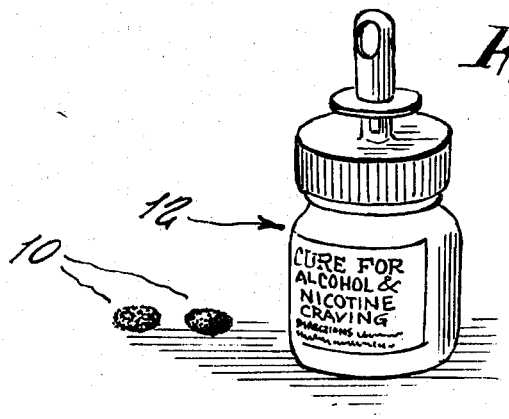
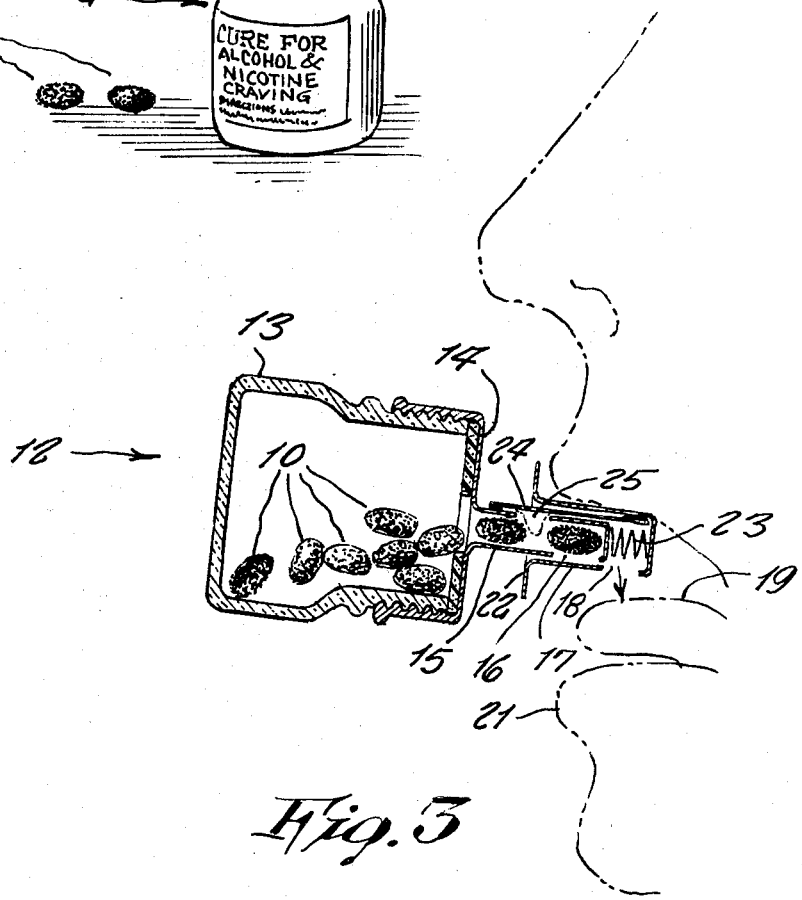
Fig. 3

MEDICATION DISPENSER

This invention relates generally to medications.

It is well known that there are a great many persons who are addicted to tabacco and whiskey, but who would like to break this addiction.

Breaking such an addiction is a very difficult thing, due to the excessive craving that is developed therfore by the person. Heretofore, numerous programs and other means have been developed to aid such person's however, in spite of this, many of them still retain a strong undeminished craving.

Therefore, it is a principal object of the present invention to provide a medication pellet dispenser for tabacco and whiskey craving that may possibly help persons who have not yet found other means for a cure.

Another object is to provide a dispenser for medication in pellet form, for deposition upon a person's tongue where the taste buds of the tongue are effected thereby so to stop the tabacco and whiskey craving.

Yet another object is to provide a container from which the pellets can be ideally dispended for placement in a mouth or upon a tongue.

Other objects are to provide cure pellets and a container which are simple in design, inexpensive to manufacture, rugged in construction, easy to use and efficient in operation.

These and other objects will be readily evident upon a study of the following specifications and the accompanying drawing wherein:

FIG. 1 is a perspective view of several of the cure pellets.

FIG. 2 is a perspective view of several of the pellets together with a dispensing container.

FIG. 3 is a side cross sectional view of the container shown dispensing a pellet upon a tongue.

Refering now to the drawing in detail, the reference numeral 10 represents a pellet according to the present invention. The pellets are made in a relatively small overload retained upon a person's tongue or kept in a person's mouth. The pellets are accordingly left there so to effect the taste buds of the tongue.

A container 12 for conviently carrying the pellets on a person, and easily dispensing the same without touching them by a hand, includes a small bottle 13 fitted with a closure cap 14 screwed thereupon. The cap includes a hollow projection 15 into which the pellets can enter one behind another for being dispensed through a side opening 16 which is normally closed by a slidable hollow knob 17 fitted therearound. The knob has a side opening 18 which aligns with opening 16 so as to allow a pellet to fall out upon a person's tongue 19, when a person's lips 20 or 21 depress against a flange 22 of the knob so to slide the knob against a return coil spring 23 located between the end walls of the projection and knob. The knob is retained from falling off the projection by a thin leaf spring 24 which at its opposite ends is connected to the projection and knob, and which, when the knob is depressed, bends inwardly (as shown by dotted lines in FIG. 3) through a side opening 25 in the projection so to serve as stop for arresting a second or following pellets to be dispensed at a same time with a pellet to be dispensed at a same time with a pellet in the outward end of the projection. Thus only one pellet can be dispensed at a time.

While various changes may be made in the detail construction, it is understood that such changes will be within the spirit and scope of the present invention as in defined by the appended claims.

What is claimed is:

1. The combination of medication pellets and a dispenser for dispensing individual pellets directly into a users mouth comprising a container for said pellets having an opening at one end in combination with means for dispensing said pellets, said means being insertable into a users mouth and responsive to contact with the users lips to dispense pellets one at a time wherein said container comprises a small bottle for containing a plurality said pellets, and a screw cap on said bottle having a hollow projection in which said pellets enter one behind another, a dispensing opening in a side of said projection, being normally closed by a knob around said projection, able relative to a side opening in said knob for aligning with said projection side opening, a flange around said knob, a compression coil spring between end walls of said projection and knob, and a thin leaf spring connected at opposite ends to said projection and knob being bendable through a second opening in a side of said projection when said flange is depressed against an action of said coil spring so to extend transversely across a central passage of said projection and arrest following pellets behind a first pellet to each said dispensing opening.

* * * * *